United States Patent [19]

Turner et al.

[11] Patent Number: 4,611,762

[45] Date of Patent: Sep. 16, 1986

[54] AIRLESS SPRAY GUN HAVING TIP DISCHARGE RESISTANCE

[75] Inventors: James J. Turner; Joseph C. Waryu, both of Amherst, Ohio

[73] Assignee: Nordson Corporation, Amherst, Ohio

[21] Appl. No.: 665,028

[22] Filed: Oct. 26, 1984

[51] Int. Cl.[4] ..... B05B 5/02

[52] U.S. Cl. ..... 239/708; 239/690; 361/228

[58] Field of Search ..... 239/3, 690, 691, 704–708, 239/696, 697; 118/621, 627; 219/553, 270; 361/227, 228, 235, 56, 91

[56] References Cited

U.S. PATENT DOCUMENTS

| | | | |
|---|---|---|---|
| 3,859,506 | 1/1975 | Weckstein | 219/529 X |
| 4,258,655 | 3/1981 | Bagby et al. | 239/707 X |
| 4,355,764 | 10/1982 | Rood et al. | 239/708 |
| 4,357,526 | 11/1982 | Yamamoto et al. | 219/270 X |
| 4,426,568 | 1/1984 | Kato et al. | 219/270 |
| 4,443,361 | 4/1984 | Hierholzer, Jr. et al. | 219/270 |

FOREIGN PATENT DOCUMENTS

| | | | |
|---|---|---|---|
| 1125358 | 6/1982 | Canada | 239/690 |
| 712133 | 1/1980 | U.S.S.R. | 239/707 |

*Primary Examiner*—Joseph F. Peters, Jr.
*Assistant Examiner*—Mary Beth O. Jones
*Attorney, Agent, or Firm*—Wood, Herron & Evans

[57] ABSTRACT

A spray gun for airless atomization and electrostatic deposition of a coating material upon a substrate, including a gun nozzle tip element serving to prevent arcing from the gun nozzle tip to an adjacent electrical ground. As disclosed, the airless spray gun includes a metallic nozzle tip from which atomized liquid coating material is emitted, and the thus-emitted coating material is charged by an electrode mounted on the nozzle which is electrically isolated from the metallic tip. During use of the spray gun, the metallic tip becomes charged via electrical charge conduction through the emitted atomized coating material. To prevent arcing from the charged tip to an electrical ground, a pair of resistive threads are secured in bores in the spray gun nozzle, each having a first end electrically connected to the conductive tip and a second end extending slightly beyond the nozzle. If an electrical ground approaches the charged conductive tip, the resistive threads are positioned such that electrical energy on the tip is coupled to the electrical ground through one or both of the resistive threads in the form of a low energy corona discharge.

8 Claims, 5 Drawing Figures

AIRLESS SPRAY GUN HAVING TIP DISCHARGE RESISTANCE

DESCRIPTION OF THE INVENTION

This invention relates generally to apparatus for the airless atomization and electrostatic deposition of a coating material upon a substrate. The invention more particularly concerns such an apparatus which includes an electrically conductive nozzle tip which acquires an electrical charge during operation of the apparatus.

There are a number of commercial systems for applying a coating material to an electrically conductive substrate. One type of equipment often used includes a spray gun which atomizes and electrostatically charges the coating material, such as paint, as the material is applied to the substrate. Such electrostatic coating guns normally provide either airless or air spray atomization of the coating material.

In coating certain types of articles, such as those where a high coating delivery rate is desired, or where there is a need to penetrate into recesses, it is desirable to atomize the coating material without the presence of atomizing air. This is accomplished by projecting the coating material through a small nozzle orifice under high pressure. The interaction of the pressurized stream of coating material with the ambient air as the coating material passes through the small nozzle orifice causes the break-up, or atomization, of the coating material into small particles. These small particles are then electrostatically charged as they move toward the substrate to be coated.

The electrostatic charge applied to the particles improves the efficiency of deposition of the coating material onto the substrate. In order to electrostatically charge the atomized paint, an electrode, also referred to as an antenna, is usually located near the spray nozzle tip and is connected to a source of high voltage to establish a strong electrostatic field in the vicinity of the atomization region. The electrostatic field produced by the electrode imparts a charge to the spray particles which causes the particles to be attracted to the substrate, which is typically grounded. The charged atomized coating material is in effect drawn to the substrate, resulting in increased and more efficient deposition of the coating material.

Such airless spray guns often operate in an explosive environment. This is brought about by, for example, paint solvent vapors from the atomization of a solvent-containing paint. In such an environment it is imperative to prevent the creation of a high energy spark which might ignite solvent vapors or the like in the atmosphere. Toward this end, the gun electrode is coupled to the high voltage supply through a high resistance path, usually including a final resistor near the gun nozzle itself. In this way, if the gun electrode is moved close to an electrical ground, there is insufficient energy at the electrode to support an arc due to the effective high impedance of the high voltage source.

While the electrode, or antenna, itself, extending beyond the end of the final series resistor in the gun, is charged to a high voltage, the mass of the electrode is small. Therefore, the energy storage capacity of the electrode itself is insufficient to support an arc to an electrical ground adjacent the electrode. In practice, if the charged electrode is brought close to an electrical ground, there is a low energy corona discharge, but no arcing occurs.

Since the more metal there is in the nozzle, the greater the energy storage capability, it would be ideal to form the entire nozzle, other than the electrode, from a non-conductive material such as a plastic material. However, due to the extremely high pressures required for hydraulic atomization of a liquid coating material in an airless gun, the atomizing tip is subject to very rapid wear if constructed of a plastic material. Consequently, in almost all cases, an airless gun includes a metallic tip in the nozzle at which the atomization of the pressurized coating material occurs.

This metal gun tip is mounted in a substantially non-conductive nozzle assembly, electrically isolated from the high voltage electrode. The gun tip is also electrically isolated from ground by virtue of being mounted within the non-conductive nozzle assembly.

During a spray coating operation, the metal tip of the gun becomes electrostatically charged, primarily through conduction of electrical charge from the electrode to the tip via the atomized coating material emitted from the nozzle tip. The electrostatically charged nozzle tip, in turn, has sufficient mass and electrical charge storage capacity that an arc can be drawn from the nozzle tip to an adjacent electrical ground.

It has been found that if the nozzle is moved toward an electrical ground so that the ground approaches the nozzle tip in the vicinity of the electrode, the electrode serves as a shield for the nozzle tip, preventing an electrical discharge from the nozzle tip in the form of an arc. In this case, there is generally a low energy corona discharge of the electrode to the electrical ground accompanied by a low energy corona discharge of the gun tip via the electrode. However, if a portion of the nozzle tip distant from the electrode is moved close to an electrical ground, the gun tip is not so shielded and an arc may be produced.

In the past, an attempt was made to shield the portion of the nozzle tip distant from the electrode by providing a second electrode, electrically connected to the first electrode. For example, if the principal charging electrode is disposed above the nozzle tip, the secondary shielding electrode is located below the nozzle tip. Such a secondary shielding electrode has been provided in the past in the form of an electrode which is shorter than the principal charging electrode.

This secondary electrode was not intended to have an effect upon the electrostatic field presented to the atomized coating material exiting from the nozzle tip. However, it has been found that, while the secondary electrode serves to cooperate with the primary electrode to adequately shield the nozzle tip, preventing arcing in the presence of an electrical ground, the secondary electrode has detracted from the coating material transfer efficiency of the gun. Apparently, the introduction of the secondary electrode has reduced the particle-charging effectiveness of the electrostatic field created by the primary electrode.

Since the provision of a secondary electrode, coupled to the primary charging electrode, fails to provide the required safety without detracting from gun performance, some other means is needed to prevent possible arcing of the gun tip to an electrical ground.

It has thus been the general aim of the invention to provide an improved airless spray gun of the foregoing type which substantially insures against the occurrence of an arc from the nozzle tip to an electrical ground, without materially detracting from the effectiveness of the electrostatic field produced by the charging electrode of the gun.

This objective has been accomplished in accordance with certain principles of the invention by providing a resistive element in the gun nozzle having a first portion electrically coupled to the nozzle tip and a second, exposed portion positioned to serve as a shield for the gun tip.

In the form of the invention to be described herein, the charging electrode is positioned above the nozzle tip and two resistive threads are mounted about 90° apart below the nozzle tip. If the lower portion of the nozzle tip is moved adjacent an electrical ground, an arc is not drawn from the tip to the electrical ground, but instead there is a low energy corona discharge from one or both of the exposed ends of the resistive threads to the electrical ground. The exposed ends of the resistive threads are positioned to be generally more closely adjacent an approaching electrical ground, which approaches from a direction distant from the electrode and conductive tip, that is, which approaches from below the nozzle tip, than the lower portion of the nozzle tip. This positioning provides for a low energy corona discharge of electrical energy on the nozzle tip through one or both of the resistive elements, preventing an arc from the nozzle tip to the electrical ground. In effect, the charge in the nozzle tip is drained away through the resistive threads as a grounded object approaches.

It has also been found that although the resistive threads are coupled to the electrostatically charged nozzle tip, they produce virtually no adverse effect upon the electrostatic field created by the charging electrode.

Other objects and advantages of the invention, and the manner of their implementation, will become apparent upon reading the following detailed description and upon reference to the drawings, in which.

Figure 1:
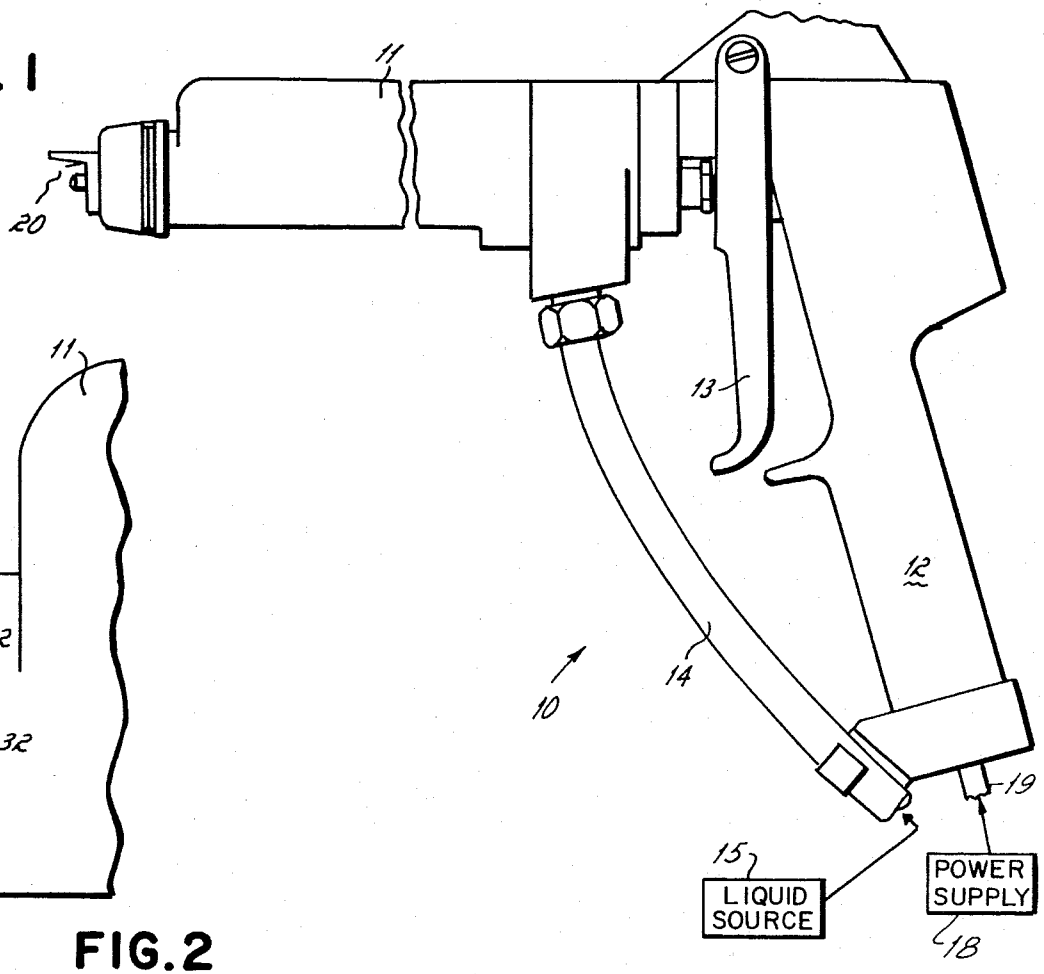
FIG. 1 is a partially diagrammatic illustration of an electrostatic airless spray coating system.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With initial reference to FIG. 1, an airless spray system includes a gun 10 formed to be held in the hand of an operator. With respect to the form of the invention to be disclosed herein, the gun 10 need not be a hand held gun but could be of a type to be mounted upon a robot, or a platform, or the like and could be either fixed or movable. In using the gun 10, articles (not shown) to be coated are generally conveyed past the gun.

The gun 10 includes a body portion 11, a handle 12, and a trigger 13. A hose 14 connects the gun with a source 15 of coating material under high pressure, typically on the order of 300 to 1,000 psi.

An electrical power supply 18 is connected to the gun 10 by a cable 19. The power supply 18 is coupled via the cable 19 through one or more resistors in the gun 10 to an electrode 20, which generates an electrostatic field to charge liquid coating material particles which are atomized by passage through a metal nozzle insert 26 mounted in a metal nozzle adapter 27 (FIG. 2).

Figure 2:
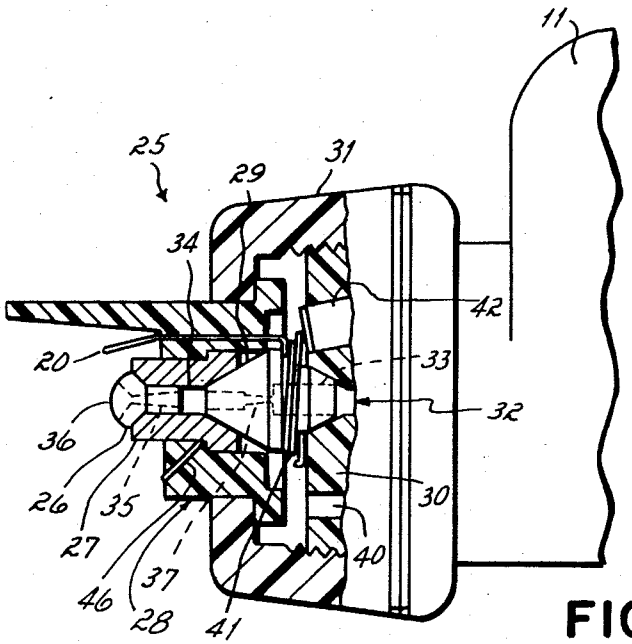
FIG. 2 is an enlarged view, partially in cross-section, of the nozzle portion of the spray gun of FIG. 1.

The structural details of the gun 10 relevant to the present invention reside in the forward end portion of the gun, as generally shown in cross-section in FIG. 2. The remainder of the gun rearwardly from this portion has not been illustrated in detail since it may be conventional, such as in the guns described in U.S. Pat. No. 3,731,145 and U.S. Pat. No. 4,355,764, commonly assigned herewith.

With further reference to FIG. 2, the nozzle assembly 25 of the gun 10 includes the nozzle adapter 27 within which is mounted the nozzle insert 26. The insert 26 is typically brazed within the nozzle adapter 27. The nozzle adapter 27 and the nozzle insert 26 shall be commonly referred to herein as the nozzle tip. The nozzle tip 26, 27 is mounted within a non-conductive nozzle support ring 28, and the nozzle tip and nozzle support ring together comprise the spray nozzle of the gun 10. The support ring 28 is held in place by a non-conductive sealing plug 29.

The sealing plug 29 is located between the nozzle adapter 27 and a gun body extension 30 for sealing a liquid flow passage which extends through the gun to the nozzle insert 26. A nozzle retaining nut 31 is threaded onto the gun body extension 30 to secure the nozzle support ring 28 in place on the gun body extension.

A central bore 32 extends axially through the gun body extension 30 and the gun body 11 into communication with the hose 14 through which coating liquid under high pressure is supplied to the gun. A conventional valving mechanism (not shown) is mounted within the central bore 32 rearwardly of the plug 29 and is operated by the trigger 13 to control the flow of liquid through the central bore 32. The forward end of the central bore 32 communicates with an axial bore 33 which extends through the plug 29, and which is aligned with the central bore 32. The plug bore 33 is in turn aligned with a bore 34 which extends axially through the adapter 27 within which is received the nozzle insert 26. The nozzle insert 26 has an axial passageway 35 terminating at an atomizing orifice 36. The sealing plug 29 includes a fluid flow restriction 37 to break up laminar flow of liquid coating material to the nozzle to produce a turbulent flow. This turbulent flow eliminates undesirable "tails" which might otherwise be formed on the edges of the pattern of liquid emerging from the nozzle orifice 36. A channel 40 in the gun body extension 30 serves as a pressure relief channel to relieve any pressure build-up which might occur, such as in the event of a plugged nozzle.

The high voltage electrostatic charging electrode 20 terminates at its rearward end in a loop 41 which is snap-fit around the circumference of the sealing plug 29. A resistor 42 having a high resistance value, such as 12 M ohms, is mounted within the gun body extension 30 and is electrically coupled at its forward end to the electrode coil 41. As indicated earlier, the high voltage power supply 18 is coupled through the cable 19 and a series of resistors (not shown) in the gun 10, the last resistor in the series being the resistor 42. The power supply 18 is thereby coupled through the series resistances including the resistor 42 to the electrode 20 via the electrode coil 41.

Figure 3:
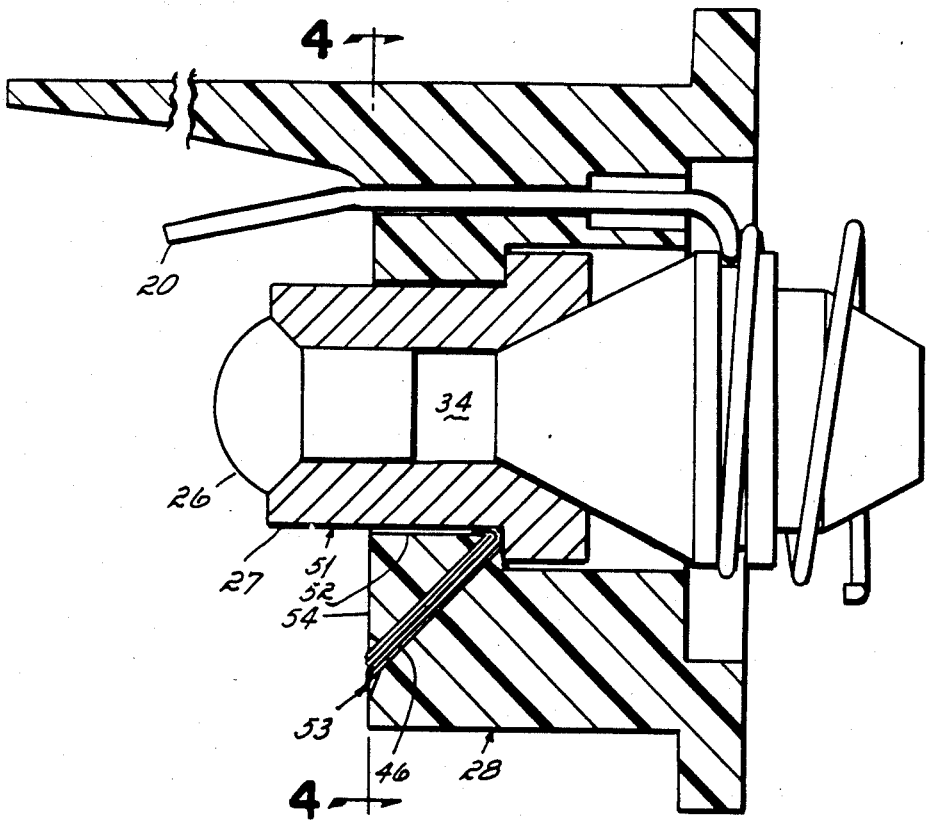
FIG. 3 is an enlarged side view, partially in cross-section, of a portion of the nozzle assembly of the gun of FIG. 2.
Figure 4:
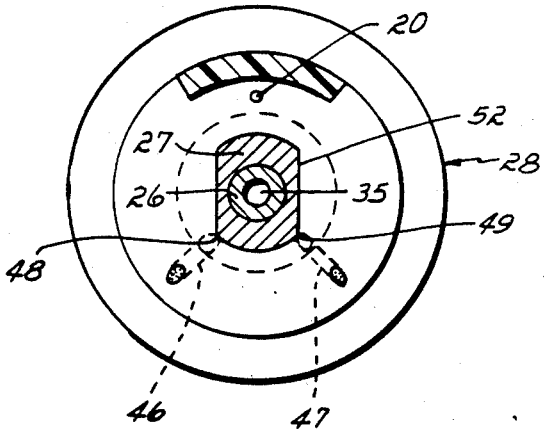
FIG. 4 is a reduced cross-sectional view of the portion of the nozzle assembly of FIG. 3, taken along the line 4—4 and in the direction of the arrows.
Figure 5:
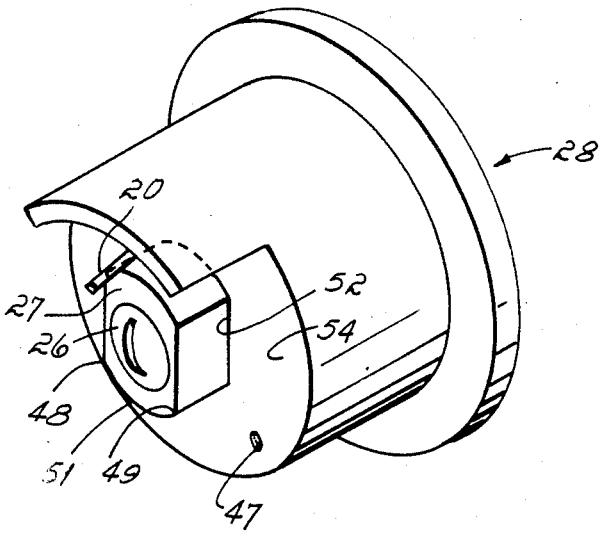
FIG. 5 is a perspective view of the front and side of the nozzle showing the longitudinal ridges on the conductive tip.

With additional reference to FIGS. 3 and 4, to protect against arcing from the nozzle tip 26, 27, a pair of resistive threads 46, 47 are secured within bores in the nozzle support ring 28. Each resistive thread has a first end in electrical contact with the nozzle adapter 27 and a second, exposed end below and outward from the nozzle adapter. As best seen in FIG. 3, each resistive thread, such as the resistive thread 46, is positioned in the nozzle support ring 28 at an angle of about 45° from horizontal. As best seen in FIG. 4, each of the resistive threads 46, 47 is also at an angle of about 45° from vertical. The resistive threads are therefore at an angle of about 90° relative to one another.

As best shown in FIG. 4, the outline of the reduced diameter portion 51 of the nozzle adapter 27 follows the outline of the central opening in the nozzle support ring 28 and is generally circular, having a pair of flattened vertical sides. This nozzle adapter shape produces a pair of ridges extending out of the nozzle support ring at the points 48, 49 in FIG. 4. These ridges on the lower half of the nozzle adapter 27 provide locations along which the electrostatic field gradient is enhanced. These ridges 48, 49 consequently are the most likely locations on the bottom of the nozzle tip illustrated for an arc to an electrical ground to occur. With the resistive threads 46, 47 positioned as shown, extending outwardly from the ridges 48, 49, respectively, the resistive threads most effectively serve as shields for the lower portion of the nozzle tip.

The threads 46, 47 are each preferably a silicon carbide thread. In one form of airless spray gun nozzle 25, the threads 46, 47 are formed from a silicon carbide continuous fiber supplied under the name NICALON by Nippon Carbon Co., Ltd. of Tokyo, Japan.

In order to place the resistive threads in the nozzle support ring 28, each multi-strand thread is "wet" at one end by applying a small amount of a fast drying adhesive. The adhesive holds the strands of the thread together, and once the adhesive has dried the thread is inserted into the ring 28 so that the rearward end of the thread extends slightly into the opening 52 in the support ring 28. To assist in guiding each resistive thread, such as the resistive thread 46, into the support ring 28, the bore in the support ring 28 for the thread 46 has a chamfered opening 53 in the front face 54 of the ring. After each resistive thread is inserted into the support ring 28, a fast drying adhesive is applied in each chamfered area to secure each resistive thread in place. After the resistive threads 46, 47 are secured in the ring 28, the adapter 27 is inserted in the opening 52, pushing the strands of the resistive threads forwardly in the space between the adapter 27 and the support ring 28. If the positioning of one or both of the resistive threads is such that some of the strands are pushed beyond the face 54 of the ring 28, these strands are trimmed at the face 54. After the nozzle adapter 27 is in place, the exposed end of each of the resistive threads is trimmed so that each thread extends beyond the face 54 of the support ring about 0.030".

Resistive threads having various values of resistance have been utilized in guns such as the gun 10, with resistances ranging from about 15 M ohms per foot to about 200 M ohms per foot. The length of each resistive thread in the support ring 28, upon completion of the illustrated nozzle assembly, is between about $\frac{3}{8}$" and $\frac{1}{2}$". Thus, for example, utilizing 100 M ohm per foot resistance thread, the resistance of each thread 46, 47 in the illustrated form of the invention is about 3 to 4 M ohms.

What is claimed is:

1. A spray gun for electrostatically coating a substrate with an atomized liquid, comprising:

a spray gun body having a passage therethrough for conveying a liquid coating material which is under pressure;

a spray nozzle on the gun body through which coating material can issue in an atomized spray, including an electrically conductive tip;

an electrode carried by the spray nozzle having a portion extending from the spray nozzle for generating an electrostatic field to charge the atomized coating material, the electrode being positioned to be electrically isolated from the conductive tip in the spray nozzle;

electrical circuit means for coupling a high voltage to the electrode; and at least one resistive element mounted in the nozzle having a first end portion proximal to, and electrically coupled via a path which excludes said liquid to, the electrically conductive tip, and having a second free end portion free of electrical connection to a source of fixed electrical potential, said second end portion being located distal from both the electrically conductive tip and said electrode to minimize arcing when an object at a potential substantially different from that of said conductive tip approaches said nozzle at a point closer to said second free end position than to said conductive tip and/or electrode.

2. The spray gun of claim 1 in which said at least one resistive element is a silicon carbide thread.

3. The spray gun of claim 1 wherein there are at least two of said resistive elements, the second free ends of which are spaced from each other and from said electrodes.

4. The spray gun of claim 3 in which each resistive element is a silicon carbide thread.

5. A spray gun for electrostatically coating a substrate with an atomized liquid, comprising:

a spray gun body having a passage therethrough for conveying a liquid coating material which is under pressure;

a spray nozzle on the gun body through which coating material can issue in an atomized spray, including an electrically conductive nozzle tip and an electrically insulative nozzle tip support, the nozzle tip being mounted in the nozzle tip support and extending forwardly therefrom;

an electrode carried by the nozzle tip support electrically isolated from the nozzle tip within the nozzle tip support, the electrode having a portion extending forwardly from the nozzle tip support above the forwardly extending portion of the nozzle tip for generating an electrostatic field to charge the atomized coating material;

electrical circuit means for coupling a high voltage to the electrode; and at least one resistive element mounted in the nozzle tip support having a first end portion proximal to, and electrically coupled via a path which excludes said liquid to, the nozzle tip, and having a second, exposed free end portion free of electrical connection to a source of fixed electrical potential, said second end portion being located (a) distal from and below the nozzle tip and (b) distal from said electrode to minimize arcing when an object at a potential substantially different from that of said conductive tip approaches said nozzle at a point closer to said free end portions than to said conductive tip and/or electrode.

6. The spray gun of claim 5 wherein there are at least two of said resistive elements, the second free ends of which are spaced from each other and from said electrodes.

7. The spray gun of claim 6 in which each resistive element is a silicon carbide thread.

8. The spray gun of claim 7 in which the nozzle tip is formed to include a pair of ridges, within the nozzle tip support and extending forwardly beyond the nozzle tip support, in a lower portion of the nozzle tip, and in which each silicon carbide thread has its first end portion in electrical contact with a different one of said ridges within the nozzle tip support.

* * * * *